US007844069B2

(12) United States Patent
Banks

(10) Patent No.: US 7,844,069 B2
(45) Date of Patent: Nov. 30, 2010

(54) MICROPHONE MOUNTING SYSTEM FOR ACOUSTIC STRINGED INSTRUMENTS

(76) Inventor: Billy Steven Banks, 620 N. Union, Independence, MO (US) 64050

( * ) Notice: Subject to any disclaimer, the term of this patent is extended or adjusted under 35 U.S.C. 154(b) by 470 days.

(21) Appl. No.: 12/042,074

(22) Filed: Mar. 4, 2008

(65) Prior Publication Data

US 2008/0253599 A1 Oct. 16, 2008

Related U.S. Application Data

(60) Provisional application No. 60/911,255, filed on Apr. 11, 2007.

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| *G10D 3/00* | (2006.01) |

(52) U.S. Cl. ..... 381/361; 381/362; 381/366; 381/368; 84/329

(58) Field of Classification Search ..... 381/361
See application file for complete search history.

(56) References Cited

U.S. PATENT DOCUMENTS

| | | | | |
|---|---|---|---|---|
| 904,258 | A | 11/1908 | Henrikson et al. | |
| 2,229,189 | A | 1/1941 | Rice | |
| 3,683,098 | A | 8/1972 | Chavez, Jr. | |
| 4,082,409 | A | 4/1978 | Bailey et al. | |
| 4,404,885 | A * | 9/1983 | Salak | 84/329 |
| 4,428,268 | A | 1/1984 | Ingoglia | |
| 4,495,641 | A | 1/1985 | Vernino | |
| 4,519,287 | A | 5/1985 | Naruse | |
| 4,534,259 | A | 8/1985 | Wolf | |
| 4,748,886 | A | 6/1988 | De Byl | |
| 4,843,937 | A | 7/1989 | Murphy | |
| 4,995,293 | A | 2/1991 | Anderson | |
| 5,010,803 | A | 4/1991 | Donnell | |
| 5,194,686 | A | 3/1993 | Winkler | |
| 6,018,120 | A | 1/2000 | Steinberger | |
| 6,441,293 | B1 | 8/2002 | LaBarbera | |
| 6,454,226 | B2 * | 9/2002 | Epping et al. | 248/160 |
| 6,515,214 | B2 | 2/2003 | Takabayashi | |
| 6,681,661 | B2 | 1/2004 | Lalonde | |
| 7,015,390 | B1 | 3/2006 | Rogers | |
| 7,084,341 | B2 | 8/2006 | Barr | |
| 7,138,577 | B2 | 11/2006 | Takabayashi | |

OTHER PUBLICATIONS

Work File: 2399585-a-Primary List; Thomson Delphion; https://www.delphion.com/patlist Feb. 3, 2007 Publication Title Representative Image Abstract.

* cited by examiner

*Primary Examiner*—Curtis Kuntz
*Assistant Examiner*—Matthew Eason
(74) *Attorney, Agent, or Firm*—Erickson, Kernell, Derusseau & Kleypas, LLC

(57) ABSTRACT

A microphone mounting system for an acoustic, stringed instrument that places the microphone in sufficient proximity to the instrument sound hole to capture the warmth and tone of the instrument while assisting in feedback control, and without altering or damaging the finish or structure of the instrument. The system includes a grip, such as a corrugated plastic tube, attached to a microphone and wedged into the instrument sound bole to be held in place through frictional engagement. The microphone is connected to an instrument cable coupler, clamped to the side of the instrument, which is then connected to a sound amplification system.

18 Claims, 4 Drawing Sheets

MICROPHONE MOUNTING SYSTEM FOR ACOUSTIC STRINGED INSTRUMENTS

CROSS REFERENCE TO RELATED APPLICATION

This application claims priority from provisional patent application No. 60/911,255 filed on Apr. 11, 2007.

BACKGROUND OF THE INVENTION

1. Field of the Invention

This invention relates to devices for mounting microphones in proximity to acoustic instruments, and, more particularly, to a system for temporarily mounting a microphone in close proximity to the sound hole of an acoustic instrument by providing an attachment element that engages the sides of sound hole and avoids alteration and/or damage to the body of the instrument.

2. Description of the Related Art

There have been numerous attempts to electrically amplify acoustic violins and other acoustic instruments with an F-style sound hole. These attempts have all suffered from significant disadvantages, typically through compromising the quality of the sound produced by the instrument, or the structure of the instrument, or both. Current solutions for acoustic amplification typically cause acoustic instruments to sound artificial and distorted.

Previous attempts to amplify acoustic stringed instruments have included the installation of electric pickup and piezoelectric amplification systems that alter the instrument's tone and render the instrument unplayable without amplification, i.e. render the instrument no longer suitable for unamplified acoustic sound production. Additionally, these methods and associated devices are often expensive, often permanently alter or damage the instrument, and achieve less than desirable resulting sound quality. Attempts to provide amplification by simply attaching microphones to the body of the instrument have also proven bulky and ineffective for use with hand-held instruments, particularly violins, that may involve significant body movement when playing. Devices that mount a microphone inside an acoustic instrument typically provide poor feedback control and offer limited adjustability to the instrument player. In addition, such devices typically require some incursion and damage to the structure of the instrument to effect installation. Prior art devices also typically do not provide sufficient cable support and stability.

Cable couplers are used for joining sequential cables that convey an output signal from an instrument to an external power amplifier. The coupler comprises a cylindrical body having a hollow sleeve at each end that form opposing receptacles. One receptacle is sized to receive a plug at the end of an instrument cable leading to an amplifier, and the other receptacle is sized to receive a plug at the end of a cable leading from a microphone or other source of an electrical sound signal. The two plugs may be the same or different sizes and, therefore, the receptacles at either end of the coupler may have the same or different dimensions.

A bracket for clamping a violin chin rest to the body of a violin typically comprises a lower clamping member for engaging the back surface of the base of a violin body and an upper clamping member for engaging the front surface of the base. The upper and lower clamping members are joined to one another by a pair of upright members disposed parallel to one another and perpendicular to the upper surface of the lower clamping member. The upright members have means for varying their length, such as turnbuckles, so that the upper and lower clamping members may be drawn together and against the adjacent surfaces of the violin, thereby holding the chin rest in a fixed position upon the violin.

Examples of amplification devices in the prior are shown in the disclosure of the following U.S. Pat. No. 7,138,577 (Takabayasi); U.S. Pat. No. 7,084,341 (Barr); U.S. Pat. No. 7,015,390 (Rogers); U.S. Pat. NO. 6,681,661 (Lalonde); U.S. Pat. No. 6,515,214 (Takabayasi); U.S. Pat. No. 6,441,293 (LaBarbera); U.S. Pat. No. 6,018,120 (Steinberger); U.S. Pat. No. 5,194,686 (Winkler); U.S. Pat. No. 5,010,803 (Donnell); U.S. Pat. No. 4,995,293 (Anderson); U.S. Pat. No. 4,843,937 (Murphy); U.S. Pat. No. 4,748,886 (De Byl): U.S. Pat. No. 4,495,641 (Vemio); and U.S. Pat. No. 4,404,885 (Salak). Examples of electrical cable couplers are well known in the art. Two particular examples are shown in the disclosure of the following U.S. Pat. No. 4,082,409 (Bailey et al.) and U.S. Pat. No. 4,519,287 (Naruse). Examples of brackets for clamping a chin rest to a violin are shown in the disclosure of U.S. Pat. No. 904,258 (Henrikson et al.) and U.S. Pat. No. 4,534,259 (Wolf).

It is clear that there exists a need for a device that can mount a small, high sound quality microphone directly over an instrument F-style, or similar, sound hole for optimal acoustic sound reproduction, while remaining easily removable and causing no damage or alteration to the structure or finish of the instrument.

BRIEF SUMMARY OF THE INVENTION

An embodiment of the invention includes a generally cylindrical deformable grip for mounting a microphone proximate a longitudinally elongated and transversely narrow acoustic instrument sound hole. The sound hole is defined by at least two opposing, elongated walls that are typically aligned generally parallel to one another near the central portion of the hole and then taper toward each other near the longitudinally opposed sound hole ends.

The grip comprises a deformable material such as a hollow, generally cylindrical tube made of resilient plastic or a generally cylindrical length of sponge or loam rubber. The lower end of the grip is free to fit inside the sound hole and should be sized so that the diameter of the grip, when measured across a section of the grip transverse to its longitudinal axis, exceeds the width of the portion of the sound hole selected for holding the grip The grip may then be squeezed between the user's thumb and forefinger to fit inside the sound hole, and then released to expand and exert an outwardly biased force against the adjoining sides of the sound hole.

The upper end of the grip is held within the jaws of a small clip connected to a microphone. Examples in the prior art of microphones provided with clips include various lavaliere-type transducer or condenser microphones having clips for attaching the microphones to the wearer's clothing. The microphone clip may be positioned in engagement with the grip so that the clip holds the microphone facing the sound hole, with the sound-receiving structures of the microphone pointed toward, or even slightly within, the proximate portion of the sound hole.

The microphone cable plugs into an electrical cable coupling or coupler that is secured to the side of an instrument (such as a violin) using a coupler mounting bracket. Upper and lower jaws of the coupler mounting bracket are drawn together using one or more turnbuckles to clamp the bracket to the instrument. The coupler is secured to the bracket and presents receptacles for receiving and connecting a microphone cord to an amplifier sound cord.

One embodiment of the invention includes an apparatus for mounting a microphone proximate the sound hole of an instrument, including an elongate, resilient grip, having an upper portion attached to a microphone and a lower portion abutting and held between opposing walls of the sound hole by friction.

Another embodiment of an apparatus for mounting a microphone proximate the sound hole of a stringed instrument includes a resilient grip elongate along a longitudinal axis. The grip has an upper portion extending from the midpoint of the grip to the upper end of the grip, and a lower portion extending from the midpoint of the grip to the lower end of said grip. The lower portion of the grip has a width slightly exceeding the width of the section of a sound hole selected for engagement with the lower portion. The grip width dimension is coaxial with the transverse axis of the grip. Means for attaching a microphone to the upper portion include a microphone clip, or a retaining ring or clip attached to or integral with the grip.

A further embodiment of the invention includes a method for mounting a microphone in close proximity to the sound hole of an acoustic stringed instrument. The method may include the steps of providing an elongate, resilient grip having a longitudinal major axis and a transverse minor axis, an upper portion at one end of the major axis and a lower portion at the other end of the major axis; attaching a microphone to the upper portion; and wedging the lower portion between opposing walls of the sound hole to fix the microphone in a position proximate to the sound hole. The method may further include the step of aligning the microphone toward the sound hole so that the microphone substantially overlies a proximate portion of the sound hole. The lower portion of the grip may be wedged into position within the sound hole by first squeezing the lower portion to deform it to a width slightly less than the width of the sound hole, inserting the lower portion into the sound hole, and then releasing the lower portion to allow it to expand and exert pressure against the proximate walls of the sound hole.

Yet a further embodiment of the invention may include a system for mounting a microphone proximate the sound hole of an instrument. The system may include a generally cylindrical, deformable grip disposed (wedged) within the sound hole of an instrument so as to be in frictional engagement with the adjoining walls of the sound hole; a microphone attached to the upper portion of the grip; a microphone cord in electrical engagement with the microphone at one end and terminating with a microphone cord plug at the other, opposing, end; a coupler engaged with the microphone cord plug; and, means for attaching the coupler to a coupler mounting bracket. The coupler mounting bracket includes an upper member for engaging the front surface of the instrument, proximate to aside of the instrument (and typically proximate the sound hole); a lower member for engaging the back surface of the instrument proximate the same side; and, means for connecting the upper member to the lower member in order to damp the side of the instrument between the members. The means for connecting the upper and lower members may include one or more turnbuckles that may be turned to draw the upper and lower members closer together, thereby creating an effective and easy to use clamping mechanism. The means for attaching the coupler to the coupler mounting bracket may include one or more cable ties, or alternative means such as fabric hook and loop fasteners (commonly sold under the trademark VELCRO®, owned by Velcro Industries B.V.).

The terms elongate or elongated are used herein to describe a structure having a major axis and a minor axis such that the structure is elongated along its major axis. The terms longitudinal or longitudinally are used herein to refer to an orientation or alignment of a structure substantially in parallel with, or collinear with, the major axis. The terms transverse or transversely are used herein to refer to an orientation or alignment of a structure substantially in parallel with, or collinear with, the minor axis and perpendicular to the major axis.

The term generally cylindrical is used herein to describe an elongate structure with a generally radially symmetrical cross section presenting a shape including circular but also triangular, square, pentagonal, hexagonal, and other polygonal shapes with increased number of sides, and including shapes deviating somewhat from radial symmetry (but generally retaining bilateral symmetry) such as oval and rectangular.

The term length is used herein as a measure or indication of distance along the longitudinal axis of a structure. The term width is used herein as a measure or indication of distance along a transverse axis of a structure. The terms coupler and coupling are used interchangeably. The terms microphone connector and microphone plug are used interchangeably. The terms instrument cord and amplifier cord are used interchangeably as referring to the same type of cord in the prior art, often used to connect an instrument's built in electrical system (such as guitar pickups) to an amplifier, or to connect various sound amplification or modification components to one another.

Other advantages of the invention will become apparent from the following description taken in connection with the accompanying drawings, wherein is set forth by way of illustration and example an embodiment of the present invention.

DETAILED DESCRIPTION OF THE INVENTION

As required, a detailed embodiment of the present invention is disclosed herein; however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
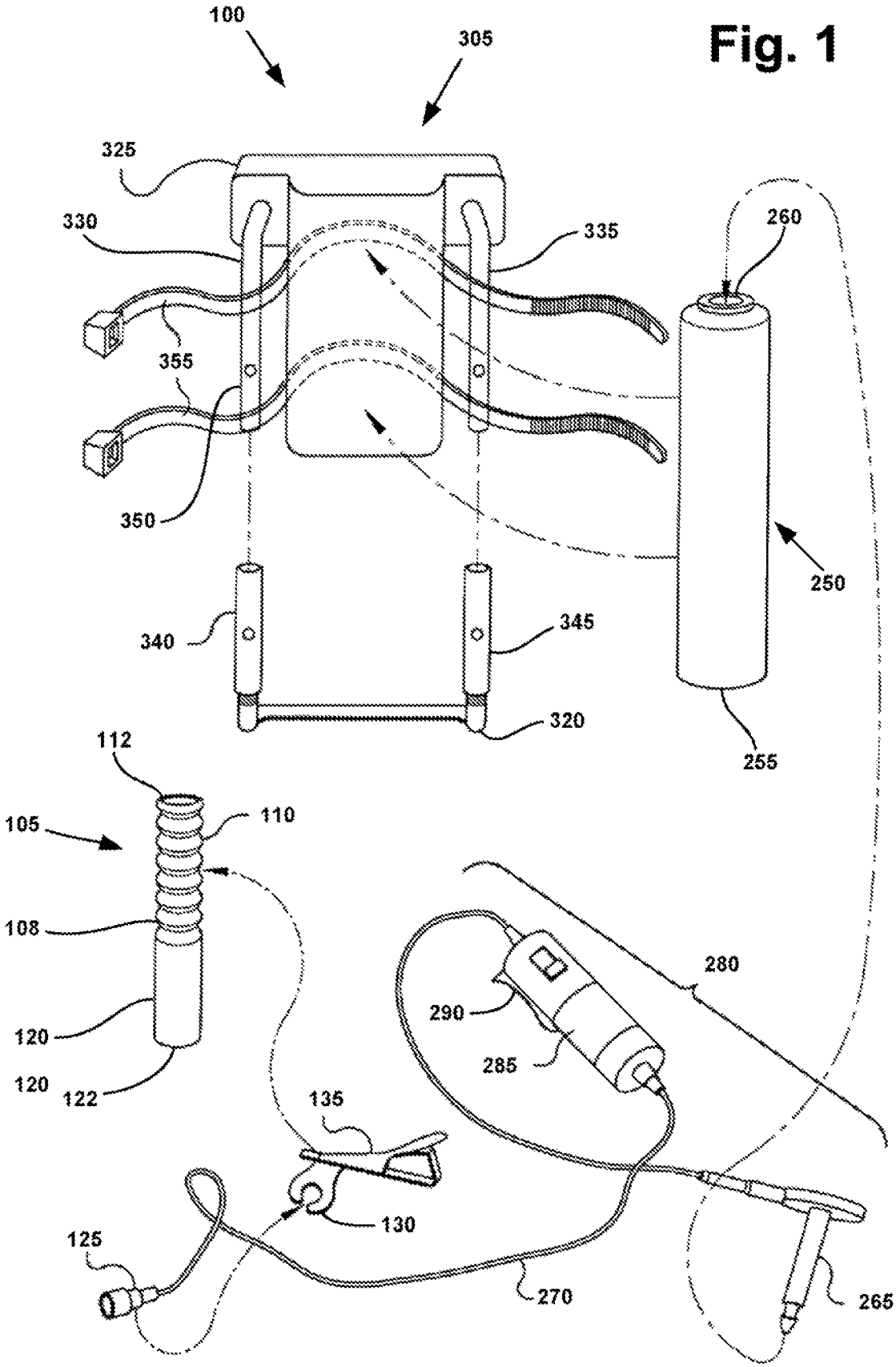
FIG. 1 is an exploded view of components of the microphone mounting system.
Figure 2:
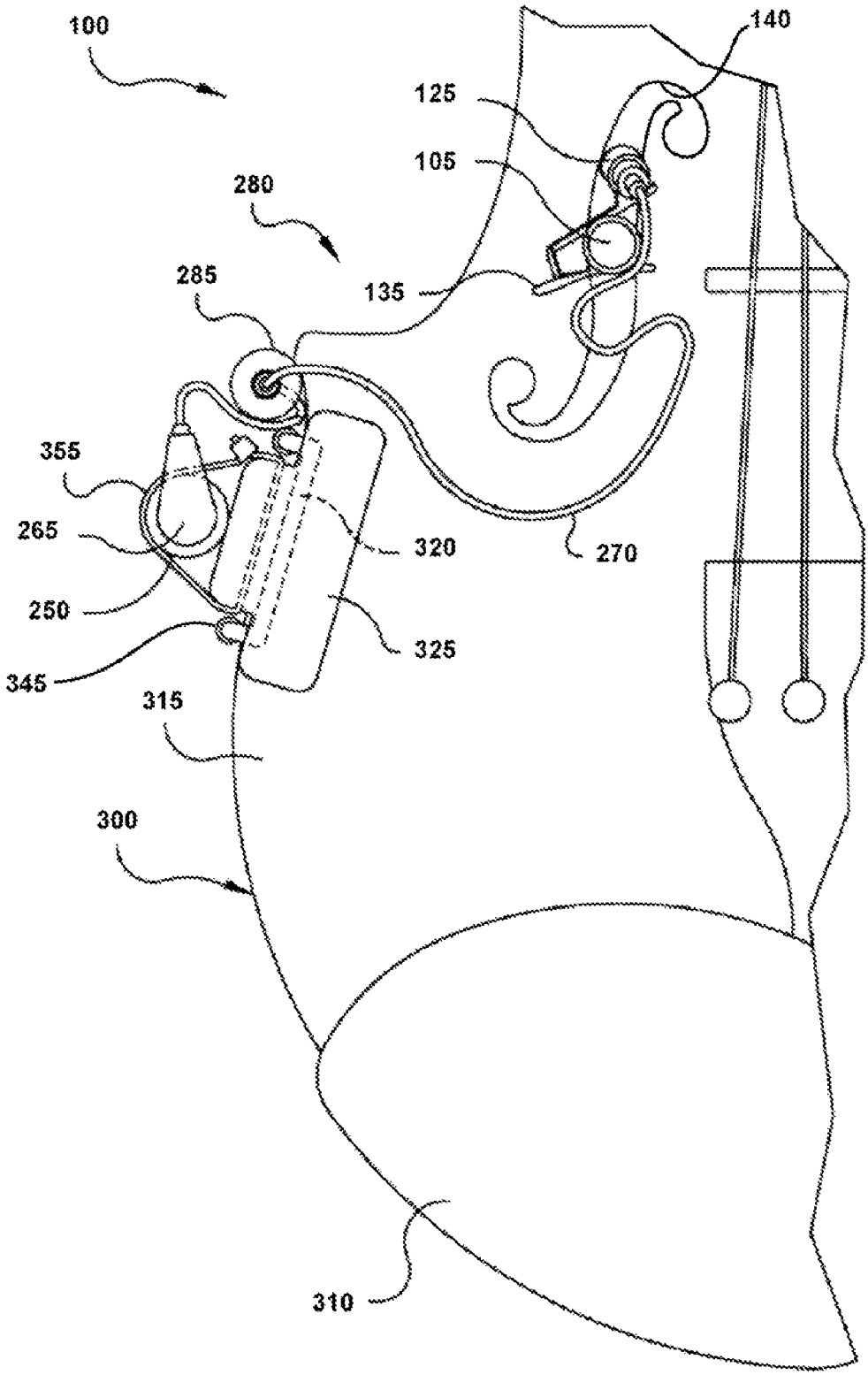
FIG. 2 is a top view of a broken away portion of a violin showing a microphone mounted over the violin sound hole and a cable coupler clamped to the side of the violin.
Figure 3:
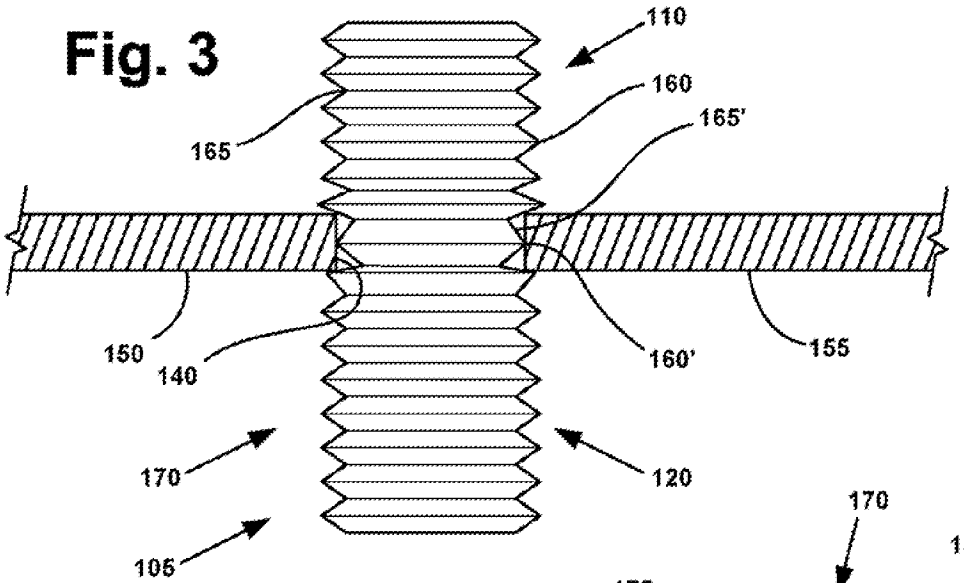
FIG. 3 is a diagram showing an elevational view of a tubular, corrugated grip positioned between the impinging walls (shown in cross section) of a sound hole.
Figure 4:
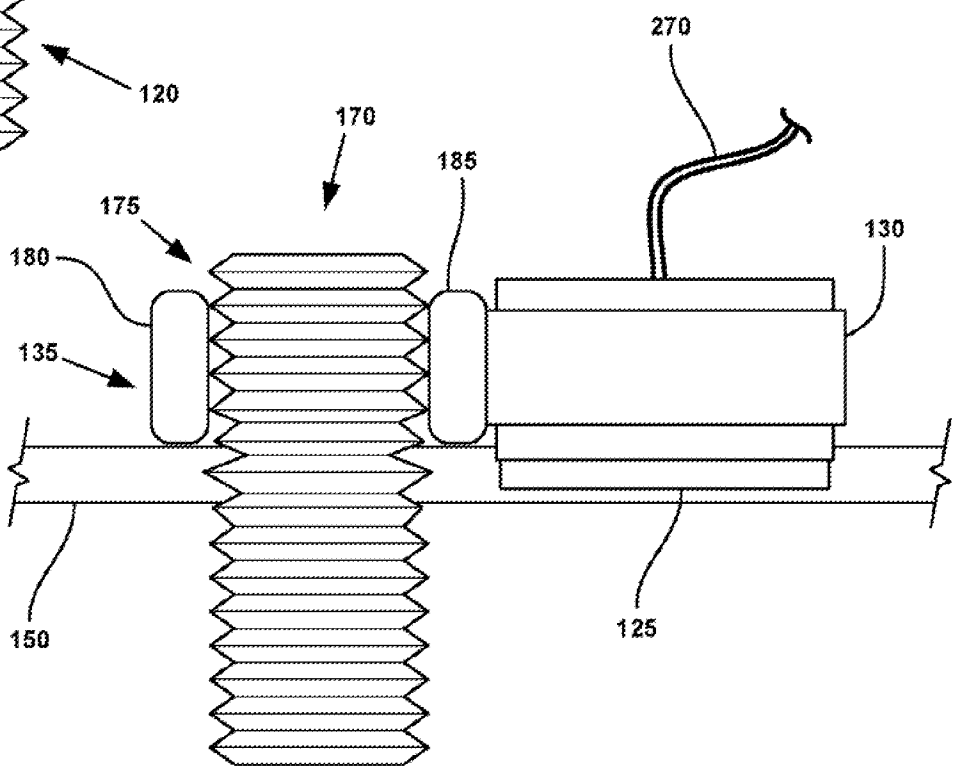
FIG. 4 is a diagram showing an elevational view of the grip of FIG. 3 showing the upper portion of the grip held between the jaws of a microphone clip.

Referring now to FIGS. 1 through 5 of the drawings, there are shown embodiments of a microphone mounting system indicated by the reference numeral 100. The main microphone mounting component is a post or grip 105 elongated along its longitudinal axis. The grip 105 is resilient and may comprise a hollow, corrugated plastic tube as shown in FIGS. 1, 3 and 4.

The grip 105 has an upper portion 110 extending from approximately the midpoint 108 to the upper end 112 of the grip 105. A microphone 125 is typically attached to the upper portion 110 of the grip 105 via a microphone retainer 130 with integral, jawed clip 135. The lower portion 120 of the grip 105 extends from approximately the midpoint 108 to the lower end 122 of the grip 105 and has a width dimension (e.g. diameter) slightly exceeding the width dimension of the portion of the instrument sound hole 140 selected for engagement with the grip 105. The lower portion 120 is fitted into the sound hole 140 by squeezing the lower portion 120 to deform it to a grip width dimension slightly less than that of the sound hole 140, inserting the lower portion 120 into the sound hole 105, and then releasing the lower portion 120 so it may exert an outwardly biased force against the sides 150 and 155 of said sound hole 140 adjacent to the lower portion 120, see FIG. 3. The grip 105 width dimension may be described as being in a plane perpendicular to the longitudinal axis of the grip 105 or as being coaxial with a transverse axis of the grip 105.

Preferably, the grip 105 is approximately two inches in length for standard violin applications. The length and diameter of the grip 105 can be varied to match the specific instrument. The grip 105 can be shorter and narrower for smaller instruments or longer and wider for larger instruments such as the viola or cello.

The cross-sectional width, e.g. diameter, of the grip 105 is generally constant along its length but variations in width are not precluded. The width may vary as long as operability is maintained. For example, the lower portion 120 of the grip 105 may include sections or steps (not shown) of incrementally decreasing diameter approaching the lower end 122 of the grip 105 in order to allow the grip 105 to be readily inserted into sound holes 140 of various dimensions. In the case of a preferred corrugated outer grip surface, the grip 105 varies in diameter from peak 160 to valley 165 of each corrugation (see FIG. 3), but the overall width measured at either the peaks 160 or valleys 165 is generally maintained along the length of the grip 105.

Various materials may be used to form the grip 105, however, a flexible, hollow, corrugated, plastic tube, including a generally cylindrical wall having an inner surface and an outer surface, offers secure attachment to the sound hole 140 and provides a material that will not damage surface finishes.

The grip 105 may comprise elongated, generally cylindrical, tubular and/or foam posts comprising urethane, polypropylene, polyethylene, polyether, polyester, polyvinyl chloride, or butyl-rubber; and/or may comprise one or more elastomers including polyisoprene (natural rubber), butyl rubber, polybutadiene, styrene-butadiene rubber, nitrile rubber, polychloroprene such as neoprene, ethylene propylene rubber, ethylene propylene diene rubber, polyacrylic rubber, silicone rubber, fluorosilicone rubber, fluoroelastomers (such as those sold under the VITON® trademark owned by Dupont Performance Elastomers, LLC), perfluoroelastomers, polyether block amides, chlorosulfonated polyethylene, ethylene-vinyl acetate, polyurethane rubber, elastomeric proteins (protein rubber) such as resilin, and polysulfide rubber. Materials such as extruded or expanded polystyrene foam, natural or synthetic sponge, or wood materials, such as cork, could also be used to form the grip 105.

A lavaliere style microphone 125 may be attached to the grip 105 with a jawed clip (alligator clip) 135 projecting from a retainer 130 that holds the microphone 125 in place. Alternatively, a retainer 205 for holding the microphone 125 may be integral with the body of the grip 200, as shown in FIG. 5, or attached to the grip by other means such as thermal welding, solvent welding, adhesive or, less preferably, mechanical fasteners such as screws or rivets attaching the retainer to the grip.

FIGS. 3 and 4 illustrate a grip 105 comprising a circumferentially corrugated, resilient, plastic tube positioned within a sound hole 140. This corrugated grip 105 embodiment will be specifically referenced herein as grip 170. FIG. 3 is an elevational view of the grip 170 with the walls 150 and 155 (shown in cross section) of the sound hole 140 impinging upon the sides of grip 170, thereby holding the grip 170 in a fixed position within the sound hole 140. As illustrated, the peaks 160' and valleys 165' of the corrugations proximate the walls 150 and 155 are deformed inward creating multiple angled surfaces that abut the surfaces of the side walls 150 and 155 in frictional and mechanical engagement thereby mitigating any tendency of the grip 170 to slide upward or downward or to lean to one side once put in place by the user.

FIG. 4 is an illustration of the grip 170 of FIG. 3 showing an elevational view rotated approximately 90 degrees about the longitudinal axis of the grip 170 from the view of FIG. 3. FIG. 4 shows the side of one of the sound hole walls 150 in view behind the grip 170 and the upper portion 175 of the grip held between the jaws 180 and 185 of a microphone clip 135.

Figure 5:
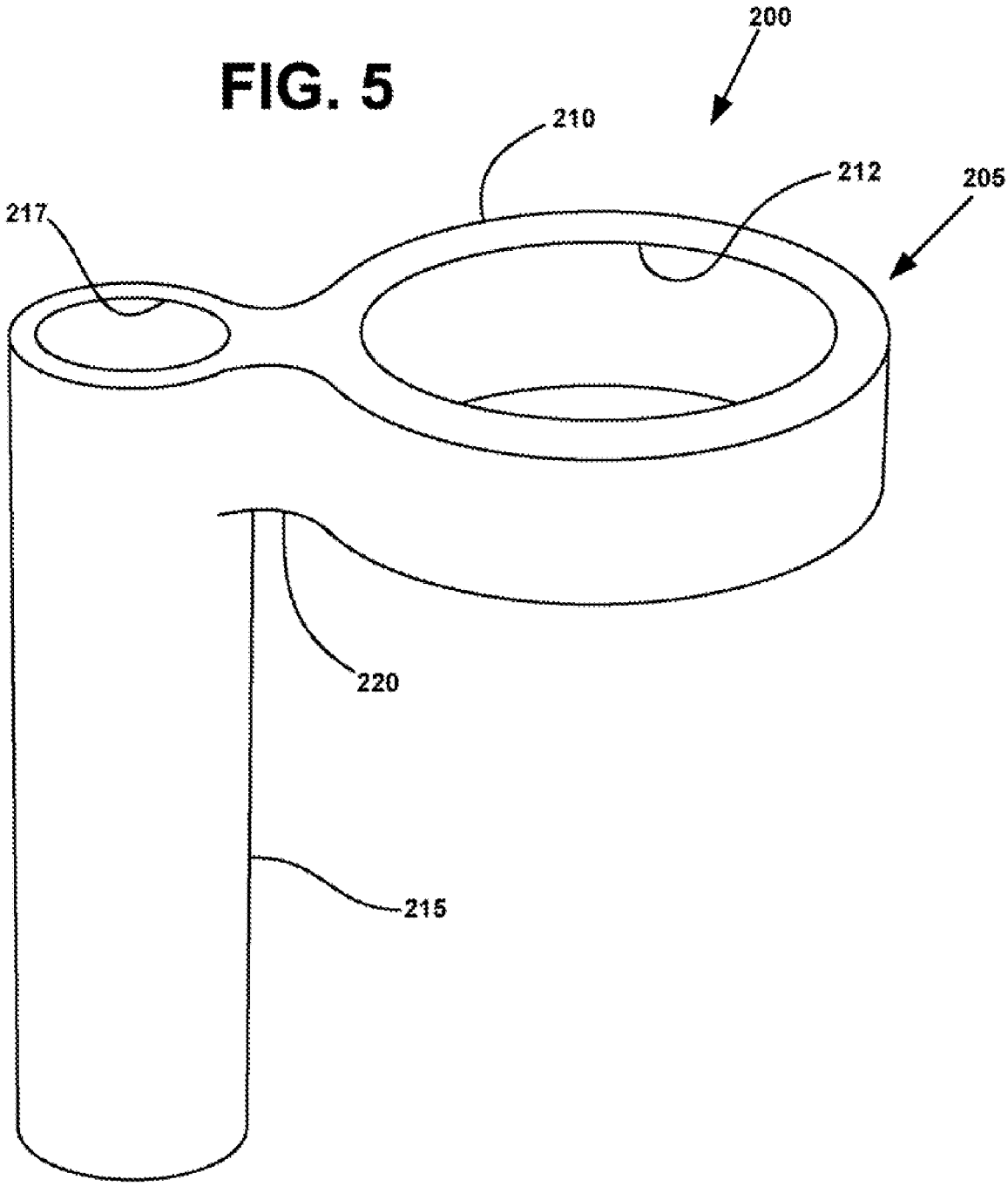
FIG. 5 is a perspective view of a grip with integral microphone retainer.

FIG. 5 provides a perspective view of an alternative embodiment of a grip 105, denominated herein as grip 200 and including an integral microphone retainer 205. The retainer 205 comprises a circular ring 210 projecting from a generally cylindrical post 215. The grip 200 may comprise molded foam rubber, rubber, or plastic, in which case the grip 200 will typically be formed (e.g. injection molded) as a single piece. Alternatively, the ring 210 may be connected at the neck 220 to the post 215 using thermal welding, solvent welding, adhesive or, less preferably, mechanical fasteners such as screws. In use, a microphone 125 is slipped into the aperture 212 of the retainer 205 and the post 215 is fitted into the instrument, sound hole 140. The post 215 may have a bore 217 therethrough, as shown in FIG. 5, or may be solid if formed of a highly resilient material such as foam rubber.

In FIG. 2, an instrument cable coupler 250 is attached to the bass or bottom left side of an instrument such as a violin 300. The coupler 250, also shown in FIG. 1, allows for connection of one electrical sound signal cable to another and passage of electrical signals therebetween. The coupler 250 will typically have a ¼ inch diameter female receptor 255 on one side to accept a standard ¼ inch plug from a typical instrument cable (not shown) used for connecting instrument electrical systems to amplifiers. The coupler 250 will typically have a ⅛ inch receptor 260 on the opposing side to accept a standard ⅛ inch plug 265 from a typical microphone cable 270. Other, non-standard sizes of couplers and plugs may readily be used as well, as long as a coupler with appropriately sized receptors is selected to match the cable plugs in use.

A shown in FIG. 2, the microphone cable connector or plug 265 is plugged into the top of the cable coupler 250. The microphone cable plug 265 can be 90 degree plug, as shown in FIG. 1, or a straight plug. A typical microphone assembly 280 includes a microphone on/off switch 285 disposed between the microphone 125 and the plug 265 with the microphone cable 270 connecting the plug 265 to the switch 285 and then the switch 285 to the microphone 125. An alternative microphone assembly may omit the microphone on/off switch 285, however, inclusion of the microphone on/off switch 285 is a superior design as this allows the microphone 125 to be readily turned off when not in use. One end of an amplifier cable may now be plugged into the bottom receptor 255 of the cable coupler 250 and the other end to an amplifier or other sound system component (not shown).

The coupler 250 may be conveniently mounted on the side of an instrument (e.g. violin 300) using a coupler mounting bracket 305. The coupler mounting bracket 305 is clamped to the side of the body of a violin 300, typically upward of the chin rest 310 and proximate the sound hole 140. FIG. 1 shows a coupler mounting bracket 305 in partially exploded view. FIG. 2 shows atop view of the bracket 305 mounted upon the left bass side 315 of a violin 300.

The bracket 305 typically comprises a lower clamping member 320 for engaging the back surface (not shown) of the violin 300 and an upper clamping member 325 for engaging the front surface. A bracket main body 350, against which a coupler 250 is held when in position upon the bracket 305, depends from the upper clamping member 325. The upper and lower clamping members 325 and 320 are joined to one another by a pair of upright members 330 and 335 disposed parallel to one another and generally perpendicular to the lower surface of the upper clamping member 325. The upright members 330 and 335 have means for varying their length, such as turnbuckles 340 and 345, so that the upper and lower clamping members 325 and 320 may be drawn together and against the adjoining surfaces of the violin 300, thereby sandwiching the violin 300 between the clamping members 320 and 325 and holding the coupler mounting bracket 305 in a fixed position upon the violin 300. An example of a similar type of bracket, though used for a different purpose, which includes turnbuckles is given in U.S. Pat. No. 904,258 to Henrikson et al., the disclosure of which is incorporated herein by reference.

The upper and lower clamping members 325 and 320 of the coupler mounting bracket 305 may comprise wood, plastic, acrylic, metal or composite material. Typically, the coupler mounting bracket 305 is one inch wide and two and one half inches long. The upper member 315 is typically two inches wide at the top and rests on the top of the violin 300 while the upright members 330 and 335 and are positioned along the side 315 of the instrument body. The coupler mounting bracket 305 dimensions may be readily determined through reference and adaptation to the dimensions of a standard violin. Various instrument sizes and shapes may be accommodated through adjustment of the bracket turnbuckles 340 and 345.

Other methods of attaching the coupler bracket 305 to an instrument include attaching the upper and lower members 320 and 325 to each other using standard nuts and bolts, or threading bolts through holes in either the upper or lower member and then into threaded engagement with tapped holes in the opposing member. The turnbuckle assembly offers the advantage of being easily installed and of a familiar design to violinists.

The coupler 250 may be attached to the coupler mounting bracket 305 with cable ties 355 or any operative alternate method of attachment such as glue, bolts, screws, clamps, fabric hook and loop fasteners, or tape. An advantage to mounting the coupler 250 with cable ties 355 is that this allows the microphone on/off switch 285 to be clipped to a cable tie 355 and provides a secure mounting method for the microphone on/off switch 285. Often, microphone on/off switches 285 in the prior art are provided with spring clips 290 for the purpose of securing the switch 285 in a fixed location, such as on the clothing of a wearer if the microphone 125 was constructed for use as a clip-on lavaliere microphone for voice amplification.

An alternate embodiment omits the cable coupler 250 from the system and merely uses a long cable from the microphone 125 to plug directly into the amplification system. The cable coupler 250, however, is typically an integral part of the mounting system since attachment of the cable coupler 250 to the body of the instrument 300, and plugging the microphone cable 270 and amplifier cable into the coupler 250 provides stability and support for the microphone 125. Without the cable coupler 250 the weight of the microphone cable 270 itself might pull the microphone 125 out of the selected position at the sound hole 140 or perhaps even pull the microphone 125 and grip 305 from the instrument entirely.

In use, the grip 105 is squeezed or compressed slightly so it will fit easily into the instrument sound hole 140. The grip 105 is oriented so that it stands vertical relative to a horizontally disposed (prone) instrument 300 as shown in FIG. 2. Once the grip 105 is inserted into the sound hole 140, it is released. When the grip 105 is released and returns to its original shape it is held tightly in place within the instrument's sound hole 140 by friction augmented by an outwardly biased, lateral force exerted by the grip 105 against the proximate walls 150 and 155 of the sound hole 140. If provided with corrugations in the lower portion 120, the grip's corrugations keep the grip 105 from falling over and allow the grip 105 to be easily repositioned in the sound hole 140 for desired results. If provided with corrugations in the upper portion 110, the grip's corrugations also help the microphone clip 135 to retain its hold upon the grip 105. Before or after installing the grip 105 into the sound hole 140, the bracket 305 is clamped onto the violin side 315 by turning the turnbuckles 340 and 345 until they are sufficiently tightened to retain the bracket 305 in fixed position while the violin 300 is in use. One end of the amplifier cable is then plugged into the coupler 250, and the other into an amplifier or other sound system component. The microphone cable is then also plugged into the coupler. The microphone switch is turned on, as is the sound system/amplifier, and the instrument may then be played with the sound being received by the microphone and amplified for listening, recording or broadcast.

An important advantage of the present invention, as demonstrated in the disclosed embodiments, is that it is a removable, non-invasive microphone mounting system 100. The microphone 125 and grip 105 can be removed while the mounting bracket 305 and coupler 250 may be left in place making for very fast and easy installation and removal. Since the entire system 100 is removable it may easily be used on multiple instruments.

It is to be understood that while certain forms of this invention have been illustrated and described, it is not limited thereto except insofar as such limitations are included in the following claims and allowable equivalents thereof.

Having thus described the invention, what is claimed as new and desired to be secured by Letters Patent is as follows:

1. An apparatus for mounting a microphone proximate the sound hole of an instrument, said apparatus comprising:

an elongate, resilient grip, said grip having an upper portion and a lower portion, said upper portion attached to a microphone, said lower portion abutting and held between opposing walls of said sound hole by friction.

2. The device of claim 1, wherein said grip comprises a flexible hollow tube.

3. The device of claim 2, wherein said tube comprises a corrugated wall.

4. The device of claim 1, wherein said grip comprises an elastomeric foam cylinder.

5. The device of claim 1, wherein said grip comprises a material selected from the group consisting of urethane, neoprene, polypropylene, polyethylene, polyester, polyether, polyvinylchloride, ethylene-propylene diene, butyl-rubber, silicone, nitrile, cork, sponge, and polystyrene.

6. The device of claim 1, wherein said grip comprises an elastomer selected from the group consisting of polyisoprene, butyl rubber, polybutadiene, styrene-butadiene kubber, nitrile rubber, polychloroprene, ethylene propylene rubber, ethylene propylene diene rubber, polyacrylic rubber, silicone rubber, fluorosilicone rubber, fluoroelastomers, perfluoroelastomers, polyether block amides, chlorosulfonated polyethylene, ethylene-vinyl acetate, polyurethane rubber, elastomeric proteins such as resilin, and polysulfide rubber.

7. In combination with an acoustic, stringed instrument having a longitudinally elongated and transversely narrow sound hole defined by at least two opposing longitudinally elongated walls, a device for mounting a microphone proximate said hole, comprising:

a generally cylindrical, deformable grip attached to said microphone, said grip interposed between said walls in frictional engagement thereto.

8. The device of claim 7, wherein said grip comprises a hollow tube.

9. The device of claim 8, wherein said tube comprises a cylindrical wall having an inner surface and an outer surface.

10. The device of claim 9, wherein the outer surface of said grip includes corrugations.

11. The device of claim 7, wherein said grip comprises an elastomeric, polymeric foam.

12. The device of claim 11, wherein said foam comprises one or more materials selected from the group consisting of polyisoprene rubber, butyl rubber, polyurethane, neoprene, polypropylene, polyethylene, polyester, polyether, polyvinylchloride, ethylene-propylene diene rubber, silicone rubber, nitrite, cork, and polystyrene foam.

13. A method of mounting a microphone in close proximity to the sound hole of an acoustic stringed instrument, the method comprising the steps of:

(a) providing an elongate, resilient grip having a longitudinal major axis and a transverse minor axis, an upper portion at one end of the major axis and a lower portion at the other end of the major axis, (b) attaching a microphone to the upper portion, and (c) wedging the lower portion between opposing walls of the sound hole to fix the microphone in a position proximate to the sound hole.

14. The method of claim 13, wherein step (c) includes the step of aligning the microphone toward the sound hole so that the microphone substantially overlies a proximate portion of the sound hole.

15. The method of claim 13, wherein step of wedging the lower portion includes the steps of:

squeezing the lower portion to deform it to a width slightly less than the width of the sound hole, inserting the lower portion into the sound hole, and releasing the lower portion, thereby allowing the lower portion to expand and exert pressure against the proximate walls of the sound hole.

16. A system for mounting a microphone proximate the sound hole of an instrument, said system comprising:

a generally cylindrical, deformable grip disposed within said sound hole and in frictional engagement with the walls thereof, a microphone attached to the upper portion of said grip, a microphone cord, one end of said microphone cord in electrical engagement with said microphone, a microphone cord plug terminating an opposing end of said microphone cord, said microphone cord plug in engagement with a coupler, means for attaching said coupler to a coupler mounting bracket, said bracket including an upper member for engaging the front surface of said instrument proximate a side thereof, a lower member for engaging the back surface of said instrument proximate said side, and means for connecting said upper member to said lower member to clamp said instrument therebetween.

17. The method of claim 16, wherein said means for connecting comprises one or more turnbuckles.

18. The method of claim 16, wherein said means for attaching comprises one or more cable ties.

* * * * *